US008256973B2

(12) United States Patent
Konno

(10) Patent No.: US 8,256,973 B2
(45) Date of Patent: Sep. 4, 2012

(54) INK RIBBON CARTRIDGE AND PRINTING APPARATUS

(75) Inventor: Hideyuki Konno, Fukushima (JP)

(73) Assignee: Oki Data Corporation, Tokyo (JP)

( * ) Notice: Subject to any disclaimer, the term of this patent is extended or adjusted under 35 U.S.C. 154(b) by 524 days.

(21) Appl. No.: 12/461,083

(22) Filed: Jul. 30, 2009

(65) Prior Publication Data

US 2010/0028065 A1 Feb. 4, 2010

(30) Foreign Application Priority Data

Jul. 30, 2008 (JP) ..... 2008-196558

(51) Int. Cl.
*B41J 32/02* (2006.01)

(52) U.S. Cl. ..... 400/202.2; 400/197; 400/200

(58) Field of Classification Search ..... 400/194–197, 400/200, 202, 202.2, 202.3, 202.4; *B41J 32/02*
See application file for complete search history.

(56) References Cited

U.S. PATENT DOCUMENTS 4,153,378 A 5/1979 Scherrer et al.
4,322,172 A * 3/1982 Furrow ..... 400/202.4
4,639,153 A 1/1987 Cheng

FOREIGN PATENT DOCUMENTS

| | | |
|---|---|---|
| EP | 0 240 112 | 10/1987 |
| EP | 0 339 829 A | 11/1989 |
| JP | 58-101770 | 7/1983 |
| JP | 63-84362 | 6/1988 |
| JP | 63-161753 | 10/1988 |
| JP | 63-281879 | 11/1988 |
| JP | 3-72465 | 7/1991 |
| JP | 08-192560 A | 7/1996 |
| JP | 9-314965 | 12/1997 |
| JP | 10-16363 | 1/1998 |
| JP | 2003-312110 | 11/2003 |

* cited by examiner

*Primary Examiner* — Leslie J Evanisko
(74) *Attorney, Agent, or Firm* — Rabin & Berdo, P.C.

(57) ABSTRACT

An ink ribbon cartridge includes an ink replenishing configuration. An ink ribbon is housed in a housing. An ink replenishing member replenishes ink into the ink ribbon. An ink storing member holds a supply of the ink, the ink storing member being movable either to a first position where the ink storing member contacts the ink replenishing member and supplies the ink to the ink replenishing member or a second position where the ink storing member does not contact the ink replenishing member and does not supply the ink to the ink replenishing member.

8 Claims, 13 Drawing Sheets

INK RIBBON CARTRIDGE AND PRINTING APPARATUS

BACKGROUND OF THE INVENTION

1. Field of the Invention

The present invention relates to an ink supplying mechanism for an ink ribbon incorporated in printing apparatuses including a serial dot impact printer.

2. Description of the Related Art

Some conventional dot impact printers incorporate an ink ribbon cartridge equipped with an ink supplying mechanism. FIG. 16 illustrates one such printer disclosed by Japanese Patent Laid Open No. H08-192560. Referring to FIG. 16, a conventional dot impact printer is equipped with an ink ribbon cartridge 112D that holds an endless type ink ribbon 111 impregnated with a liquid ink. A printhead 113 is mounted on a carriage unit 115. The ink ribbon 111 extends through a gap between a printhead 113 and paper 114. The wires (not shown) of the printhead 113 impact the ink ribbon 111 to print on the paper 114.

The amount of ink (not shown) in the ink ribbon 11 decreases as printing is carried on. An ink tank 120 supplies the ink to the ink ribbon 111.

The carriage unit 115 is driven by a spacing motor 116 and pulleys 117*a* and 117*c* to move leftward and rightward reciprocally across the paper 114.

A spacing belt 118 is disposed about the pulleys 117*a* and 117*c*. The carriage unit 115 is fixed to the spacing belt 116. The spacing motor 116 rotates to cause the carriage unit 115 to move in directions shown by arrows A and B. The ink ribbon cartridge 112D is fixed to side frames 119*a* and 119*b*, and accommodates an ink tank 120 with an ink replenishing strip 121 in contact with the ink ribbon 111. Thus, the ink is directed from the ink tank 120 to the ribbon 111 by capillary action.

A transfer roller 122 is in rotatable contact with the ink replenishing strip 121. A drive roller 123 rotates in pressure contact with the transfer roller 122 so that when the drive roller 123 rotates, the transfer roller 122 will also rotate. When printing is performed, the spacing motor 116 drives the carriage unit 115 to move leftward and rightward so that the printhead 113 moves across the paper 114.

The pulleys 117*a* and 117*b* are mounted on the shaft of the spacing motor 116. The pulley 117*b* includes gear teeth in mesh with a gear 124*a*, which in turn is in mesh with a gear 124*b*. When the ink ribbon cartridge is attached to the printer, the gear 124*b* moves into meshing engagement with a drive shaft located on a body of the dot impact printer. The drive shaft fits in a drive roller 123 so that the drive shaft is concentric to the drive roller 123. The spacing motor 116 drives the pulley 117*b*, gear 124*a*, and gear 124*b* to rotate, thereby driving the drive roller 123 in rotation.

Thus, the ink ribbon 111 advances through a gap between the transfer roller 122 and the drive roller 123. The ink replenishing strip 121 is in pressure contact with the transfer roller 122.

The ink is supplied from the ink tank 120 to the transfer roller 122 through the ink replenishing strip 121. Then, the ink is transferred onto the ink ribbon 111 from the transfer roller 122. In this manner, the ink is replenished to the ink ribbon 111.

However, the ink replenishing strip 121 of the aforementioned conventional configuration is in contact with the transfer roller 122 at all times. Therefore, if the ink ribbon cartridge 112D is left unused for a long period of time, an excess amount of ink stays only at an area where the transfer roller 122 is in contact with the replenishing strip 121. The ink ribbon 111 that has absorbed excess ink will result in uneven density of printed images such as spread of ink at the beginning of a new printing operation shortly after replacement of the ink ribbon cartridge 112D, which shortens the useable life time of the ink ribbon cartridge 112D due to excess initial density of printed characters.

SUMMARY OF THE INVENTION

An object of the invention is to provide an ink ribbon cartridge capable of preventing an excess amount of ink from staying at an area in which an ink replenishing member is in contact with a transfer roller even if the ink ribbon cartridge is left unused for a long period of time.

An ink ribbon cartridge includes an ink replenishing configuration. An ink ribbon is housed in a housing. An ink replenishing member replenishes ink into the ink ribbon. An ink storing member holds a supply of the ink, being movable either to a first position where the ink storing member contacts the ink replenishing member and supplies the ink to the ink replenishing member or a second position where the ink storing member does not contact the ink replenishing member and does not supply the ink to the ink replenishing member.

Another ink ribbon cartridge includes an ink replenishing configuration. A roller rotates to advance an ink ribbon. An ink replenishing member is in contact with the roller, the ink replenishing member supplying ink to the roller via the roller. A blocking member is in sandwiched engagement with the roller and the ink replenishing member such that the blocking member is held between the roller and the ink replenishing member, the blocking member blocking supply of ink from the ink replenishing member to the roller, the blocking member being fixed at its one end to a housing. An urging member urges the blocking member in such a direction as to be away from the roller and the ink replenishing member. The blocking member is in friction contact with a part of the roller until the blocking member is worn out to cut off. When the blocking member is worn out to cut off, the urging member pulls the blocking member out of the sandwiched engagement.

A printer includes the aforementioned ink ribbon cartridge. A drive mechanism causes the ink storing member to move into contact engagement with the ink impregnable. A controller meters an amount of ink consumed during printing, metering being started for a first printing operation shortly after a new, unused ink ribbon cartridge is attached to an apparatus. The drive mechanism exerts the external force on the ink storing member when the controller detects that the amount of ink consumed reaches a predetermined value.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
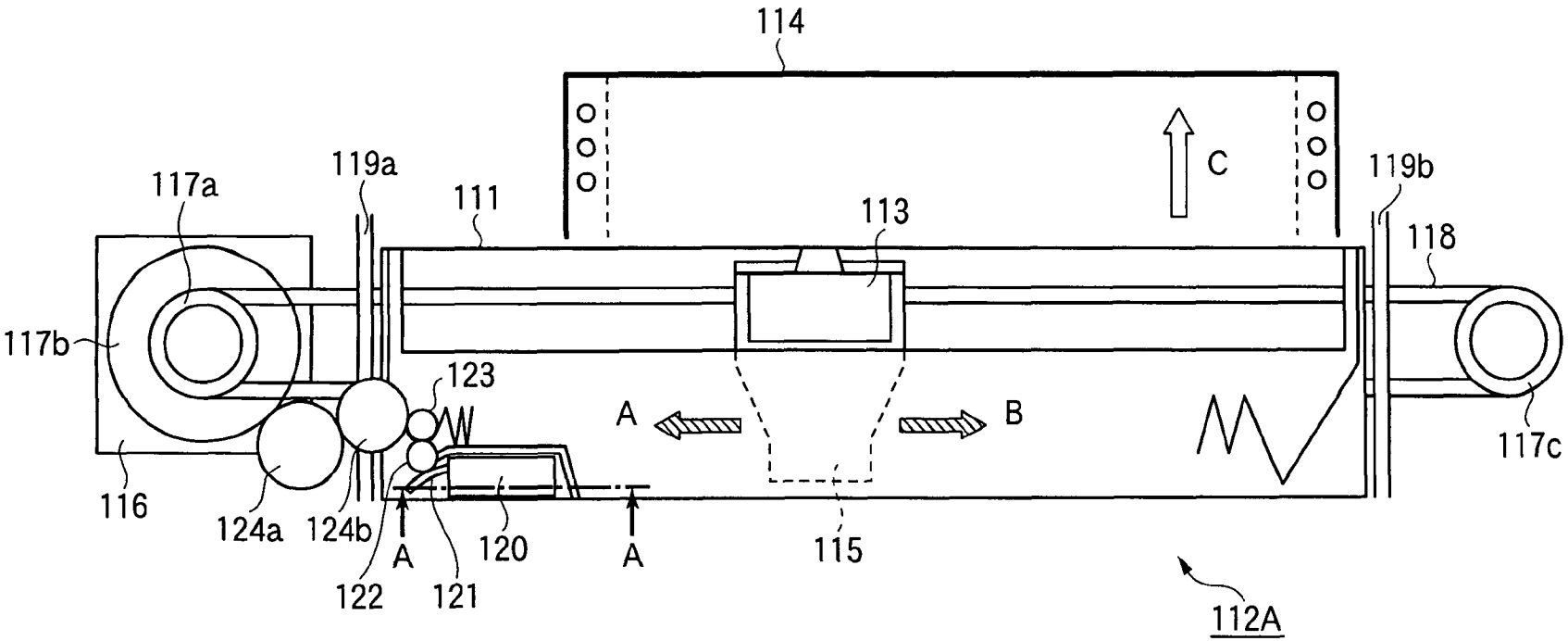
FIG. 1 illustrates the configuration of an ink ribbon cartridge and a printing apparatus of a first embodiment.

Embodiments of the present invention will be described with reference to the accompanying drawings. Like elements have been given like reference numerals throughout the drawings.

First Embodiment

{Construction}

FIG. 1 illustrates the configuration of an ink ribbon cartridge and a printing apparatus of a first embodiment. Referring to FIG. 1, a carriage unit 115 is fixed to a portion of a spacing belt 118, and supports a printhead 113 thereon.

Pulleys 117*a* and 117*b* are mounted to a drive shaft (not shown) of a spacing motor 116 and configured to rotate on the drive shaft. When the spacing motor 116 is energized, the spacing motor 116 drives the spacing belt 118 to rotate so that the carriage unit 115 and printhead 113 move in directions shown by arrows A and B.

The pulley 117*b* is in mesh with a gear 124*a* which in turn is in mesh with a gear 124*a*. The gear 124*b* is coupled to another drive shaft which is concentric to the drive roller 123 in the ink ribbon cartridge 112A. Once a user has attached the ink ribbon cartridge 112A to side frames 119*a* and 119*b*, the drive roller 123 is in coupling engagement with the drive shaft (not shown).

Thus, when the space motor 116 is energized, the drive shaft is driven in rotation via the pulley 117*b* and gears 124*a* and 124*b*, causing the drive roller 123 in the ink ribbon cartridge 112A to rotate. Thus, the ink ribbon 11 is advanced while being sandwiched between the transfer roller 122 and the drive roller 123.

Figure 2:
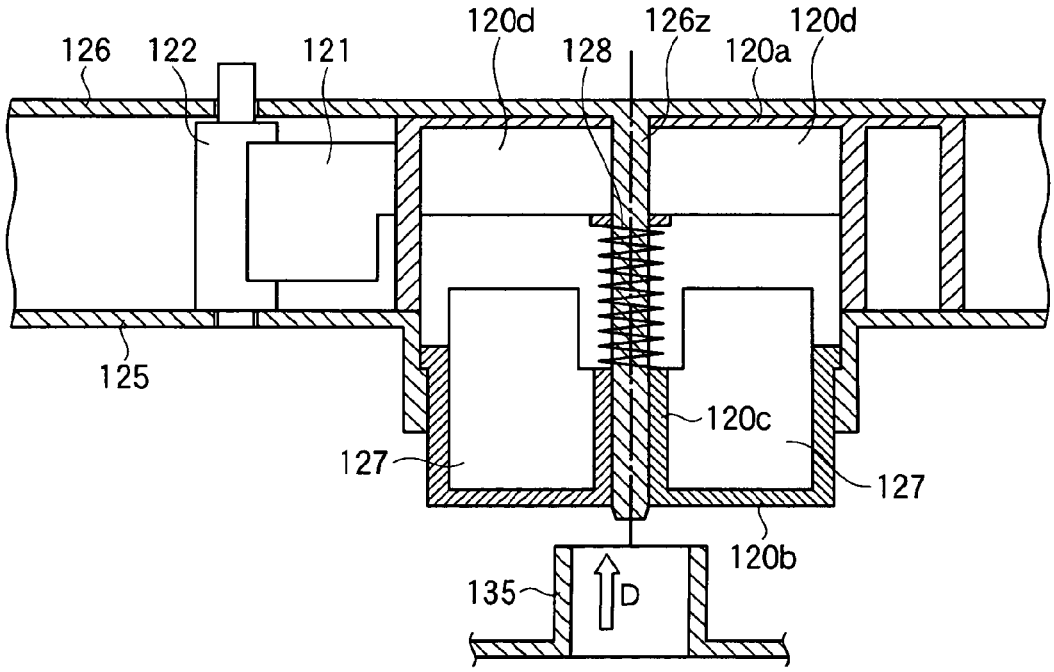
FIG. 2 is a cross-sectional view of a pertinent portion of the ink ribbon cartridge taken along a line A-A of FIG. 1.
Figure 3:
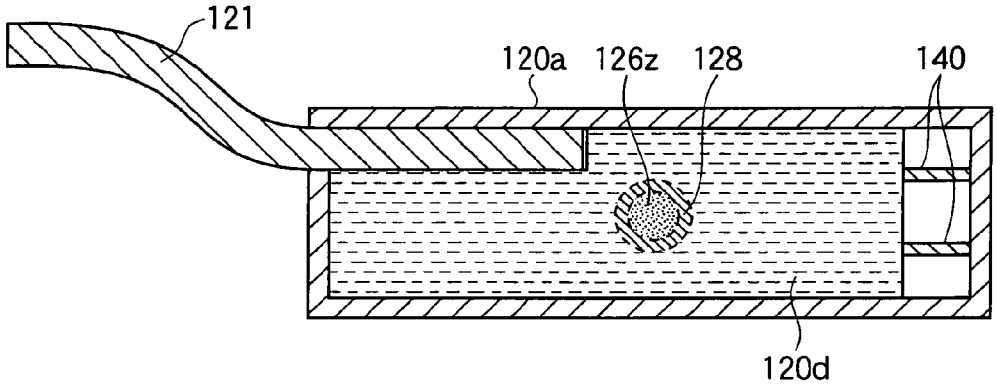
FIG. 3 is a top view of the ink replenishing strip coupled to an upper ink tank.

FIG. 2 is a cross-sectional view of a pertinent portion of the ink ribbon cartridge 112A taken along a line A-A of FIG. 1. FIG. 3 is a top view of the upper ink tank 120*a* and ink replenishing strip 121 coupled to the upper ink tank 120*a*. Referring to FIG. 2, a box-like housing 125 of the ink ribbon cartridge 112A is formed of a synthetic resin, and opens at one widthwise end portion of the ink ribbon cartridge 112A. A lid or a cover 126 of the ink ribbon cartridge 112A is formed of a synthetic resin, and covers an opening formed in the housing 125 of the ink ribbon cartridge 112A.

The cover 126 includes a supporting member 126*z* formed in one piece with the cover 126. The upper ink tank 120*a* is generally rectangular box-shaped, and accommodates an ink impregnable member 120*d* having the replenishing strip 121 connected at its one end. The supporting member 126*z* extends through the upper ink tank 120*a* so that the upper ink tank 120*a* is held in position in the ink ribbon cartridge 125 with the ink replenishing strip 121 in contact with the transfer roller 122.

The ink impregnable member 120*d* is supported between retaining ribs 140 (FIG. 3) in a sandwiched relation. An ink storage medium 127 is disposed below the retaining ribs 140, and is accommodated in a lower ink tank 120*b*. The ink impregnable member 120*d* includes a hole through which the supporting member 126*z* extends. The ink storage medium 127 includes a hole through which a hollow cylindrical portion 120*c* extends. The ink storage medium 127 receives the supporting member 126*z*.

The ink impregnable member 120*d* is in the form of non-woven fabric, textile fabric, sponge, or the like, and is not impregnated with ink before it is unsealed. The ink storage medium 127 is in the form of non-woven fabric, textile fabric, sponge, or the like. The ink replenishing strip 121 is in the form of felt which is highly resilient and highly impregnable. The ink storage medium 127 is not in contact with the ink impregnable member 120*d* before it is unsealed.

The supporting member 126*z* extends through a spring 128 disposed between the upper ink tank 120*a* and the lower ink tank 120*b*. The lower ink tank 120*b* and upper ink tank 120*a* are urged by the spring 128 in directions away from each other. Thus, the ink tank 120*b* and ink tank 120*a* will not contact with each other.

A cylindrical push-up rib 135 is disposed on a body of a printer such that the push-up rib 135 is concentric to the supporting member 126*z*.

{Operation}

Figure 4:
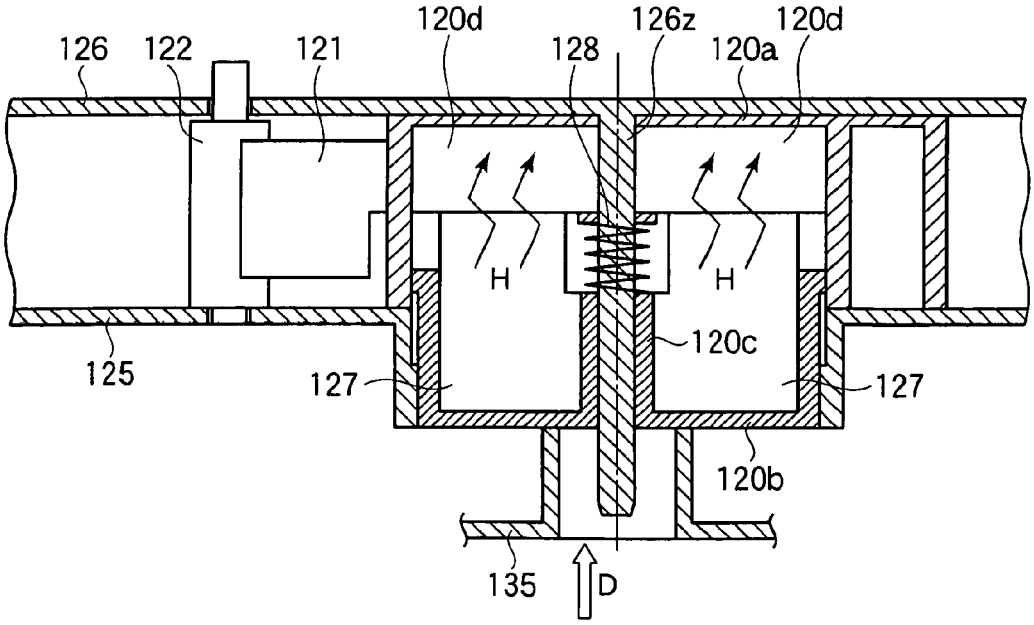
FIG. 4 is a cross sectional view taken along a line B-B of FIG. 5, and illustrates a pertinent portion of the ink ribbon cartridge.
Figure 5:
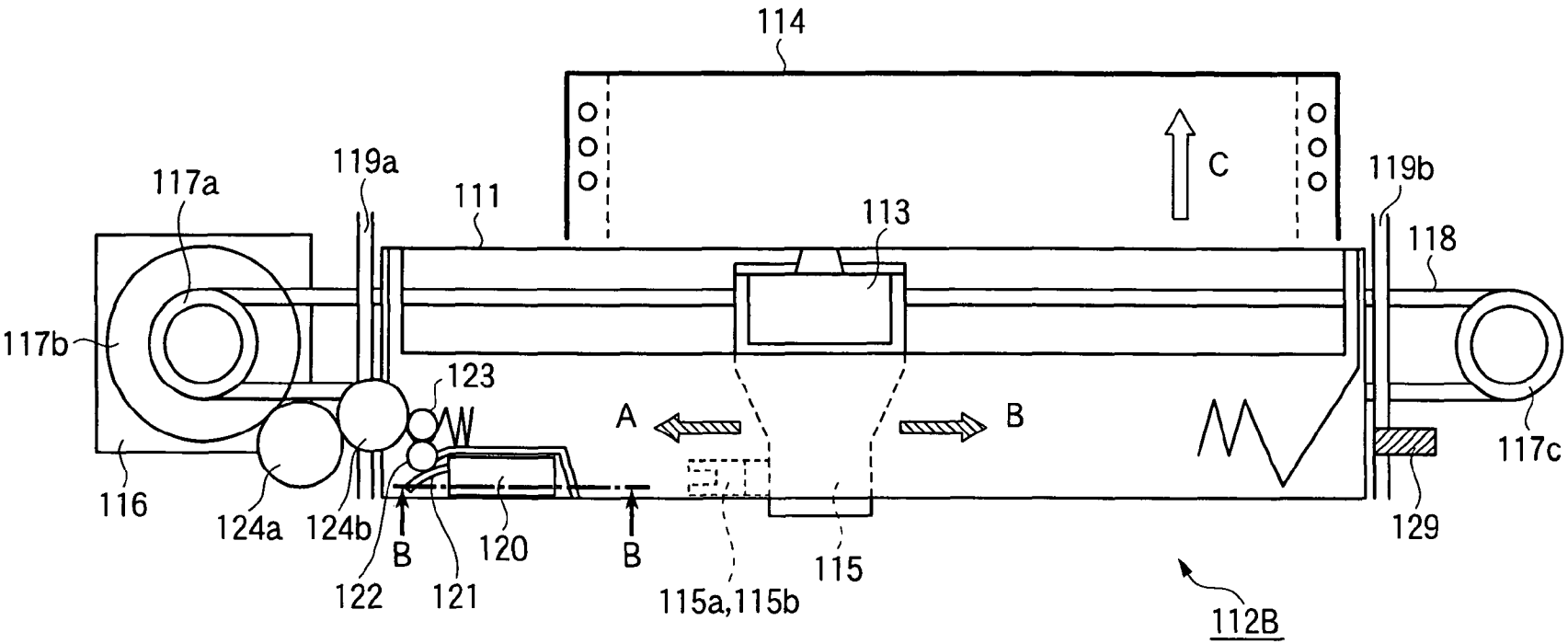
FIG. 5 illustrates the general configuration of an ink ribbon cartridge and a printer of a second embodiment.

FIG. 4 is a cross sectional view taken along a line A-A of FIG. 5, and illustrates a pertinent portion of the ink ribbon cartridge. The operation of the ink ribbon cartridge of the aforementioned configuration and the printer will be described with reference to FIG. 4.

When an operator attaches the ink ribbon cartridge 112A to side frames 119*a* and 119*b*, the push-up rib 135 pushes up the lower ink tank 120*b* in a direction shown by arrow D, so that the ink storage medium 127 is brought into pressure contact with the ink impregnable member 120*d* held in the upper ink tank 120*a*.

The ink impregnable member 120*d* draws by capillary action the ink from the ink storage medium 127 in a direction shown by arrow H. The configurations (i.e., materials and structures) of the ink storage medium 127, ink impregnable member 120*d*, and ink replenishing strip 121 are such that $t1 \cong t2$ where t1 is an average time required for the ink in the ink ribbon 111 to be consumed during printing and t2 is an amount of time required for the ink held in the ink storage medium 127 to reach the transfer roller 122 through the ink replenishing strip 121 and the ink impregnable member 120*d*.

This ensures that the ink storage medium 127 supplies the fresh ink only by an amount actually consumed during printing.

When the printer receives a print command from a host apparatus, a controller in the printer drives the spacing motor 116 to cause the carriage unit 115 to move leftward and rightward across the paper, so that the printhead 113 performs printing. The spacing motor 116 also drives the pulley 117*b* and the gears 124*a* and 124*b* for rotation, thereby causing the drive shaft (not shown) to rotate, so that the drive roller 123 in the ribbon cartridge 112A rotates to advance the ink ribbon 111 held between the transfer roller 122 and drive roller 123 in sandwiched relation.

The ink starts to be replenished into the ink ribbon 111 only after the ink ribbon 111 has made several complete revolutions in one direction. Therefore, an appropriate amount of ink may be supplied to the ink ribbon 111.

{Advantages}

As described above, the ink tank includes the upper ink tank 120*a* and the lower ink tank 120*b*. The upper ink tank 120*a* includes the ink replenishing strip 121 and ink impregnable member 120*d* while the lower ink tank 120*b* accommodates the ink storage medium 127 therein. When the ink ribbon cartridge 112A has been attached to the printer, the lower ink tank 120*b* has moved into abutting engagement with the upper ink tank 120*a* so that the ink storage medium 127 is brought into pressure contact with the ink impregnable member 120*d* to supply the ink to the ink ribbon 111 through the ink replenishing strip 121 and transfer roller 122. This configuration is effective in preventing the ink from staying at an area where the ink replenishing strip 121 is in pressure contact with the transfer roller 122.

The configuration makes efficient use of the ink because the time required for the ink in the ink ribbon 111 to be exhausted is substantially equal to the time required for the ink to be supplied from the ink storage medium 127 to the ink ribbon 111 via the ink impregnable member 120*d*, ink replenishing strip 121, and transfer roller 122.

Second Embodiment

FIG. 5 illustrates the general configuration of an ink ribbon cartridge 112B and a printer of a second embodiment. Elements similar to those in the first embodiment have been given the same reference numerals and their description is omitted.

Figure 6:
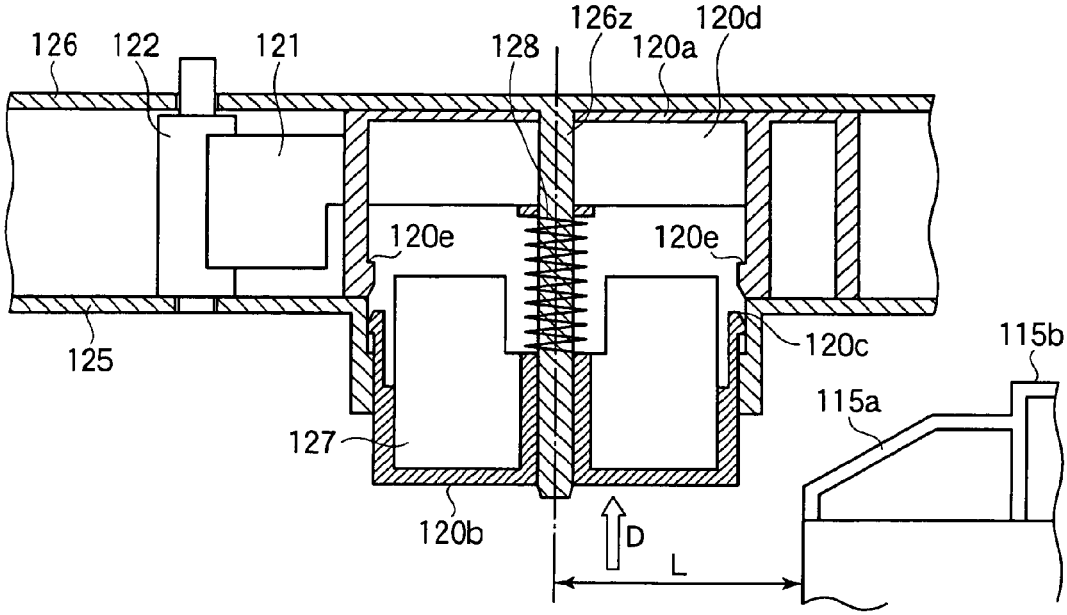
FIG. 6 is a cross sectional view taken along the line B-B of FIG. 5, and illustrates a pertinent portion of the ink ribbon cartridge.

FIG. 6 is a cross sectional view taken along a line B-B of FIG. 5, and illustrates a pertinent portion of the ink ribbon cartridge 112B. Hooks 120*c* are formed in a lower ink tank 120*b*. When the lower ink tank 120*b* moves toward an upper ink tank 120*a*, the hooks 120*c* move into hooking engagement with engagement portions 120*e* formed on the upper ink tank 120*a*.

Figure 7:
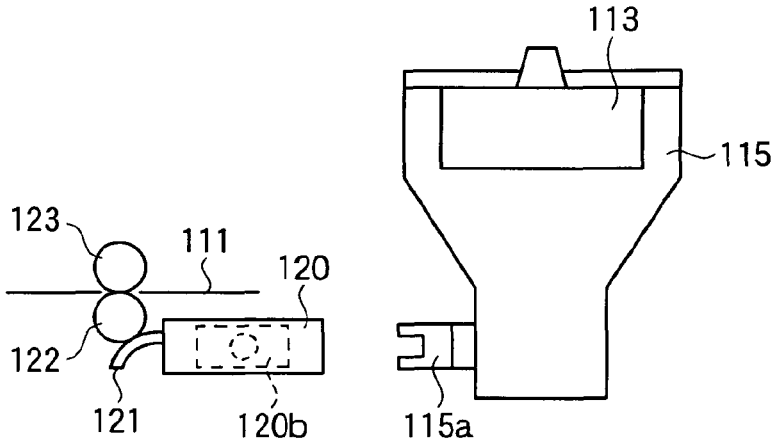
FIG. 7 is a top view of a pertinent portion of the second embodiment.

FIG. 7 is a top view of a pertinent portion of the second embodiment.

Referring to FIG. 7, a carriage unit 115 includes a projection 115*b* at its lower end portion. The lower ink tank 120*b* is disposed in the path of the projection 115*b* so that an inclined surface 115*a* of the projection 115*b* engages the bottom of the lower ink tank 120*b* when the carriage unit 115 moves in a direction shown by arrow A (FIG. 5). The carriage unit 115 moves further a predetermined distance L after it abuts the bottom of the lower ink tank 120*b* so that the inclined surface 115*a* enters under the lower ink tank 120*b* pushing the lower ink tank 120*b* out of the way and an ink storage medium 127 toward the upper ink tank 120*a*. Thus, the ink storage medium 127 moves into pressure contact with the ink impregnable member 120*d* in the upper ink tank 120*a*.

The carriage unit 115 is controlled in its movement so that the projection 115*b* will not interfere with the lower ink tank 120*b* during the normal printing operation. A side frame 119*b* includes a sensor 129 mounted thereto. The sensor 129 detects when the ink ribbon cartridge 112B is attached to the printer.

Figure 8:
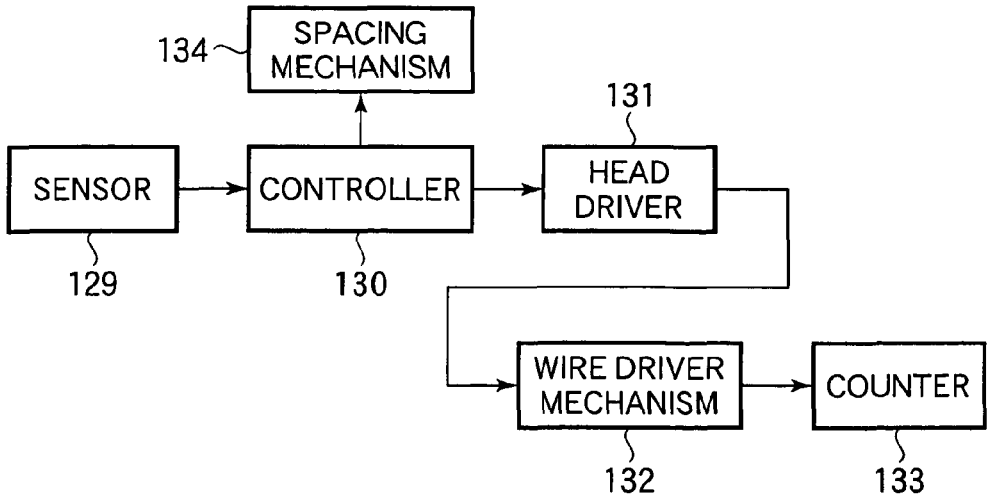
FIG. 8 is a block diagram illustrating the control system of the printer of the second embodiment.

FIG. 8 is a block diagram illustrating the control system of the printer of the second embodiment. A spacing mechanism 134 drives under control of a controller the carriage unit 115 to move in directions shown by arrows A and B in FIG. 5. A wire driver mechanism 132 receives a control command from a head driver 131, and drives printing wires under control of the control command.

The consumed amount of ink in the ink ribbon 111 is proportional to the number of printed dots. A counter 133 counts the cumulative number of times the printing wires are driven, thereby metering an amount of ink consumed during printing. The counter 133 starts counting for a first printing operation shortly after a new, unused ink ribbon cartridge is attached to an apparatus. When the count of the counter 133 reaches a predetermined value, the carriage unit 115 is displaced against the ink tank 120*b* by a predetermined distance L so that the lower ink tank 120*b* is pushed by the inclined surface 115*a* out of the way. Thus, the ink storage medium 127 is brought into pressure contact with the ink impregnable member 120*d*.

{Operation}

Figure 9:
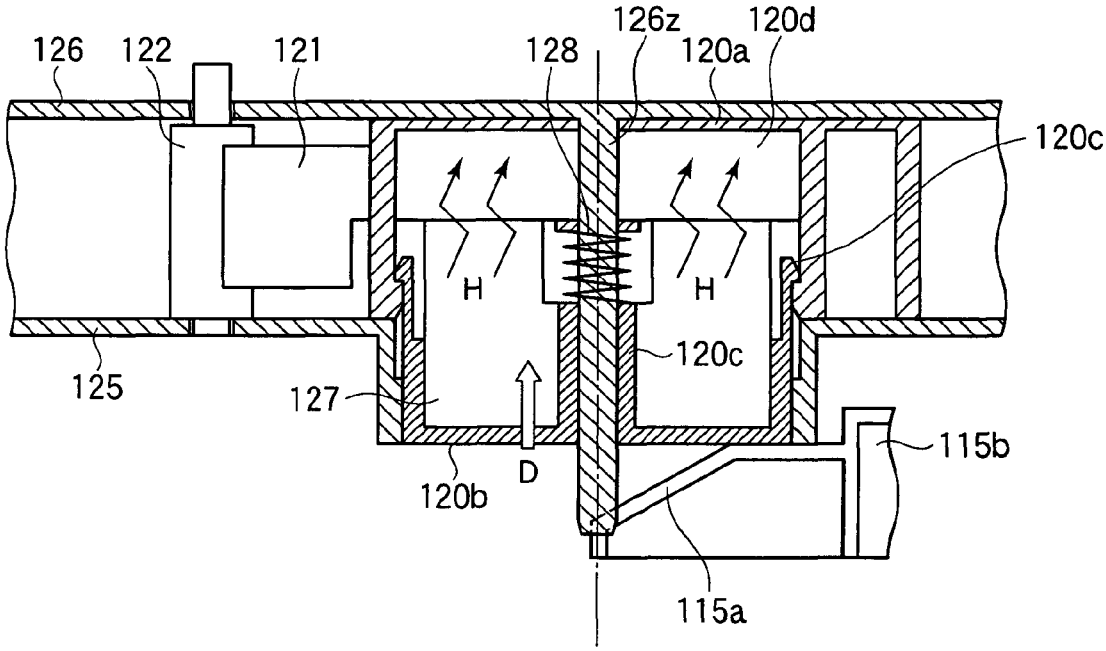
FIG. 9 illustrates the operation of the ink ribbon cartridge of the second embodiment.
Figure 10A:
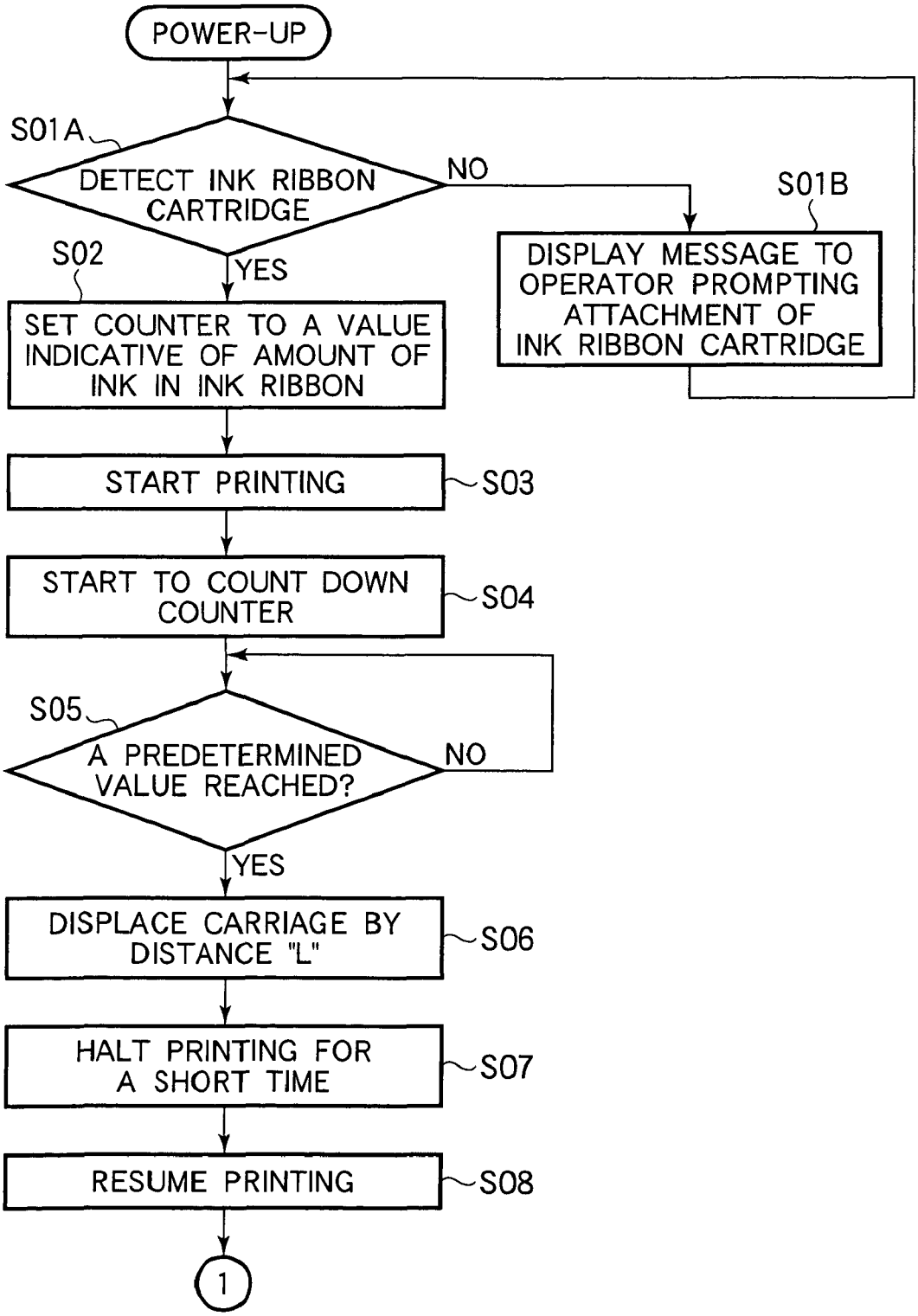
FIGS. 10A and 10B are a flowchart illustrating the operation of a print controller of the second embodiment.
Figure 10B:
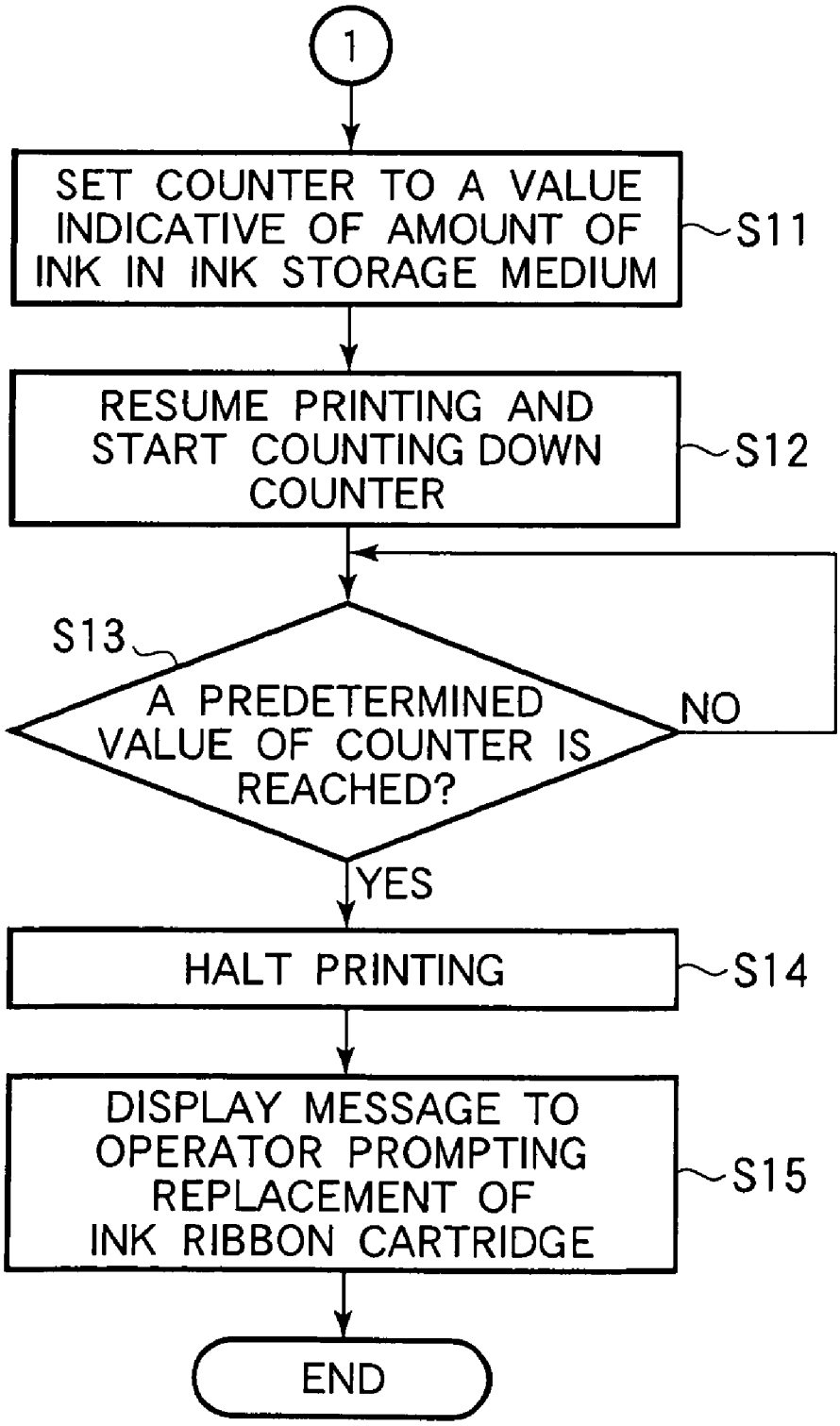

FIGS. 10A and 10B are a flowchart illustrating the operation of print controller of the second embodiment. The operation of the ink ribbon cartridge 112 and printer of the aforementioned configuration will be described with respect to FIGS. 5, 9, and 10A-10B.

Upon power-up of the printer, a spacing motor 116 drives the carriage unit 115 to take up a starting position in the A and B directions in FIG. 5.

First, the carriage unit 115 moves in the A direction. When a starting position sensor (not shown) detects the carriage unit 115, the space motor 116 runs in the reverse direction so that the carriage unit 115 moves in the B direction until the carriage unit 115 takes up a predetermined position.

A sensor 129 disposed on the side frame 119*b* detects the ink ribbon cartridge 112B (S01A). If the sensor 129 fails to detect the ink ribbon cartridge 112B (N at S01A), the sensor 129 generates an alarm signal prompting a user to attach the ink ribbon 112B to the printer (S01B). If the sensor 129 detects the ink ribbon cartridge 112B (Y at S01A), the controller 130 determines that the printer is ready for printing.

The controller 130 sets a value to the counter 133 incorporated in a circuit (not shown), the value corresponding to an amount of ink in the ink ribbon 111 (S02). The controller 130 starts printing upon receiving print data, and causes the counter 133 to count down by "1" during printing every time a dot is printed. Printing is started (S03). Thus, an amount of ink of the ink ribbon 111 consumed during printing may be detected in terms of the count of the counter 133. (S04).

The spacing motor 116 drives the pulleys 117*b* and gears 124*a* and 124*b* to rotate, causing a drive shaft (not shown) to rotate, so that the drive roller 123, coupled to the drive shaft, in the ink ribbon cartridge 112B rotates.

As a result, the transfer roller 122 and the drive roller 123 cooperate with each other to advance the ink ribbon 111 held therebetween. At this moment, the upper ink tank 120*a* is not in locking engagement with the lower ink tank 120*b* so that the ink is not supplied from the ink storage medium 127 to the ink ribbon 111 via the ink impregnable member 120*d*. Thus, printing is performed using only the ink in the ink ribbon 111.

When the count of the counter 133 reaches a predetermined value due to printing (S05), the controller 130 determines that the ink in the ink ribbon 111 has been consumed completely, and then causes the carriage unit 115 to move in the A direction by a distance of L mm from a normal stop position (S06). Then, the controller 130 controls the carriage unit 115 to halt under the ink tank 120*b* for Δt seconds (S07).

The amount of movement of the carriage unit 115 is a distance L from an end of the stroke of the carriage unit 115 shown in FIG. 6. The movement of the carriage unit 115 by a distance L in the A direction causes the lower ink tank 120*b* to move toward the upper ink tank 120*a*, so that the hooks 120*c* engage the engagement portions 120*e*. Once the hooks 120*c* engage the engagement portions 120*e*, the lower ink tank 120*b* remains locked to the upper ink tank 120*a*. Thus, the carriage unit 115 needs to enter under the lower ink tank 120*b* for a very short time, i.e., only about 0.5 to 1.0 second.

FIG. 9 illustrates the operation of an ink ribbon cartridge 112B of the second embodiment.

Referring to FIG. 9, the inclined surface 115*a* on the carriage unit 115 causes the lower ink tank 120*b* and the ink storage medium 127 to move toward the upper ink tank 120*a*, so that the lower ink tank 120*b* is in pressure contact with the upper ink tank 120*a* and the ink storage medium 127 is in contact with the ink impregnable member 120*d*.

The ink in the ink storage medium 127 is drawn by capillary action in the H direction (FIG. 9). The ink is supplied to the transfer roller 122 via the ink impregnable member 120*d* and the ink replenishing strip 121. The ink replenishing strip 121 in turn supplies the ink to the ink ribbon 111.

In this manner, the ink is replenished from the ink storage medium 127 after a certain amount of ink held in the ink ribbon 111 has been consumed. Then, printing is resumed (S08).

The controller 130 again sets a value to the counter 133, the value corresponding to the amount of ink held in the ink storage medium 127 (S11). Thereafter, the controller 130 controls the counter 133 to again count down every time a dot is printed (S12).

As described above, the amount of ink in the ink storage medium 127 consumed by the printhead 113 may be measured by counting the number of printed dots. When the count of the counter 133 reaches a predetermined value (S13), the controller 130 determines that the ink in the ink storage medium 127 has been used up, and then halts printing (S14) and displays a message to the operator prompting replacement of the ink ribbon cartridge (S15).

{Advantages}

As described above, the ink tank includes the upper ink tank 120*a* and the lower ink tank 120*b*. The upper ink tank 120*a* holds the ink replenishing strip 121 and the ink impregnable member 120*d* while the lower ink tank 120*b* accommodates the ink storage medium 127 therein. The carriage unit 115 includes the inclined surface 115*a* that pushes the lower ink tank 120*b* and an ink storage medium 127 toward the upper ink tank 120*a*, so that when the count of the counter 133 reaches a predetermined value due to printing, the inclined surface 115*a* causes the lower ink tank 120*b* to move to the upper ink tank 120*a*. Thus, the amount of ink consumed from the ink ribbon 111 may be accurately detected, allowing the ink to be replenished to the ink ribbon 111 at an appropriate timing after the ink in the ink ribbon 111 has been used up.

Third Embodiment

Figure 11:
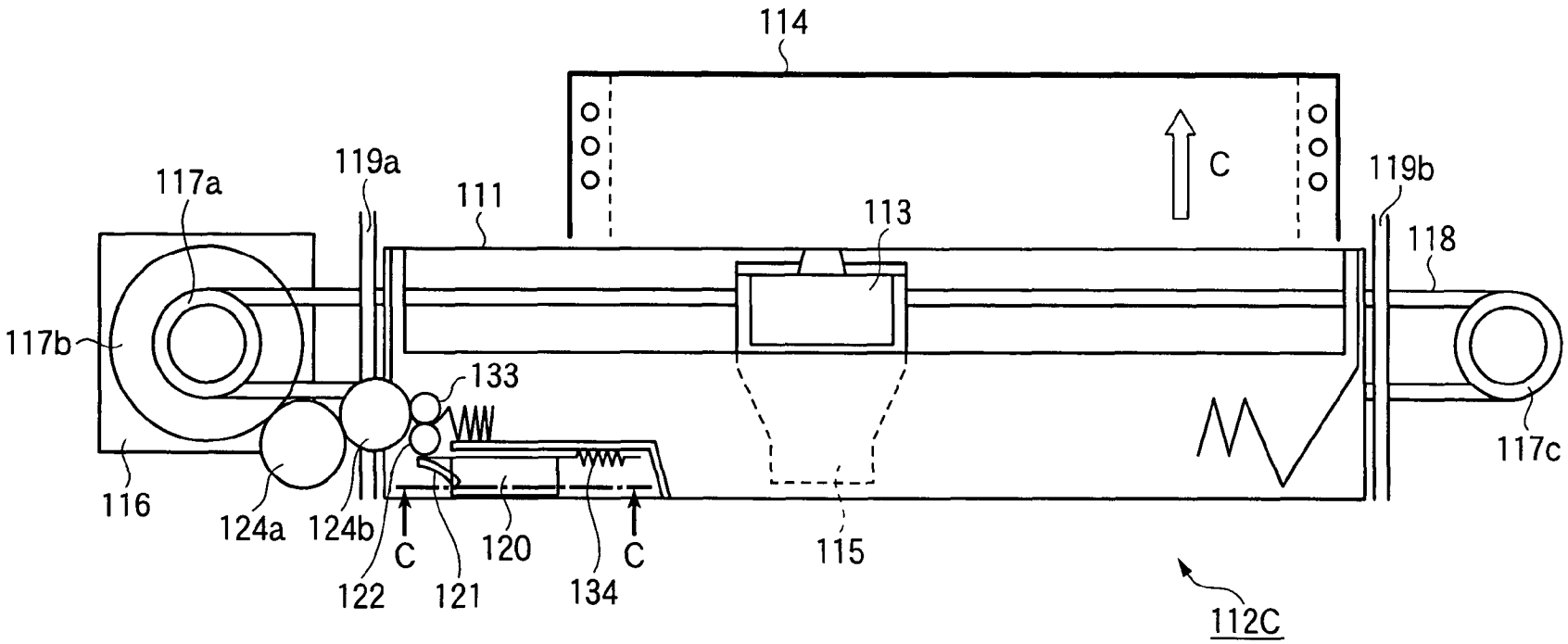
FIG. 11 illustrates a general configuration of an ink ribbon cartridge and a printer of a third embodiment.
Figure 12:
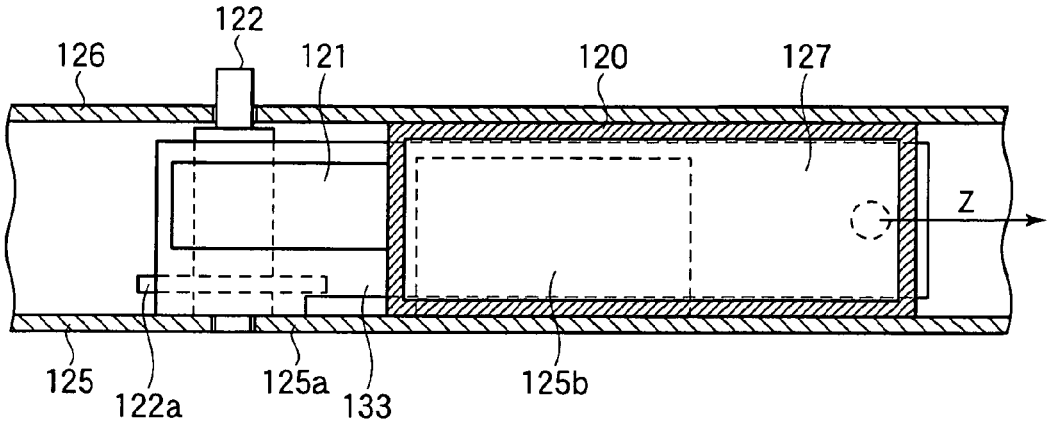
FIG. 12 is a cross-sectional view taken along a line C-C of FIG. 11, illustrating a pertinent portion of the ink ribbon cartridge.
Figure 13:
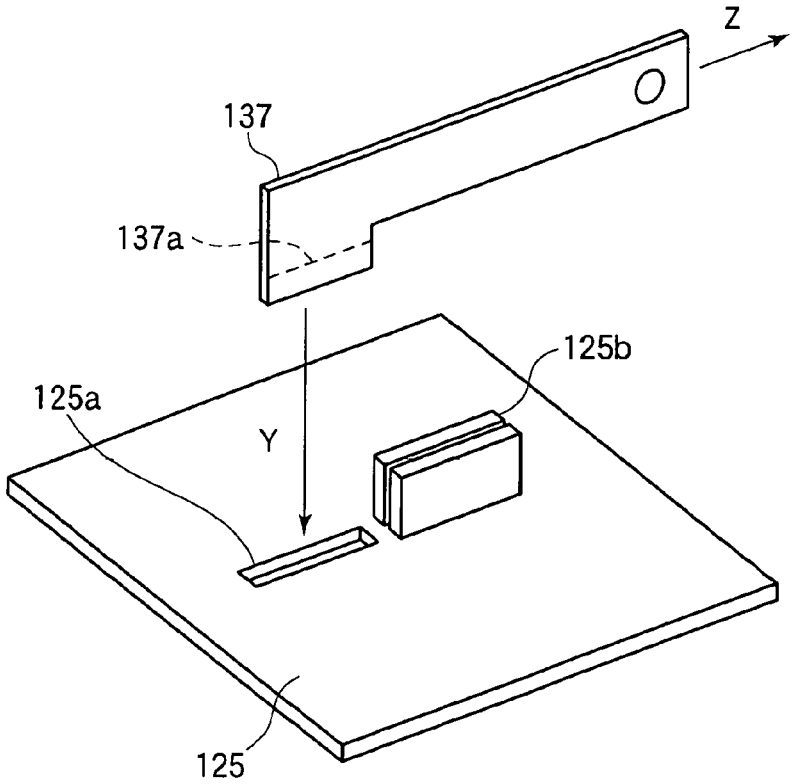
FIG. 13 is a perspective view illustrating a shutter and the ink ribbon cartridge of FIG. 11.

FIG. 11 illustrates a general configuration of an ink ribbon cartridge 112C and a printer of a third embodiment. FIG. 12 is a cross-sectional view taken along a line C-C of FIG. 11, illustrating a pertinent portion of the ink ribbon cartridge 112C. FIG. 13 is a perspective view illustrating a shutter 137 and the ink ribbon cartridge 112C.

The shutter 137 is formed of an amorphous resin material which is easy to wear out as compared to other types of synthetic resins, and is held between an ink replenishing strip 121 and a transfer roller 122 in sandwiched relationship. The shutter 137 is mounted by inserting in a direction shown by arrow Y (FIG. 13) into slits 125*a* and 125*b* formed in housing 125 of the ink ribbon cartridge 112C.

Figure 14:
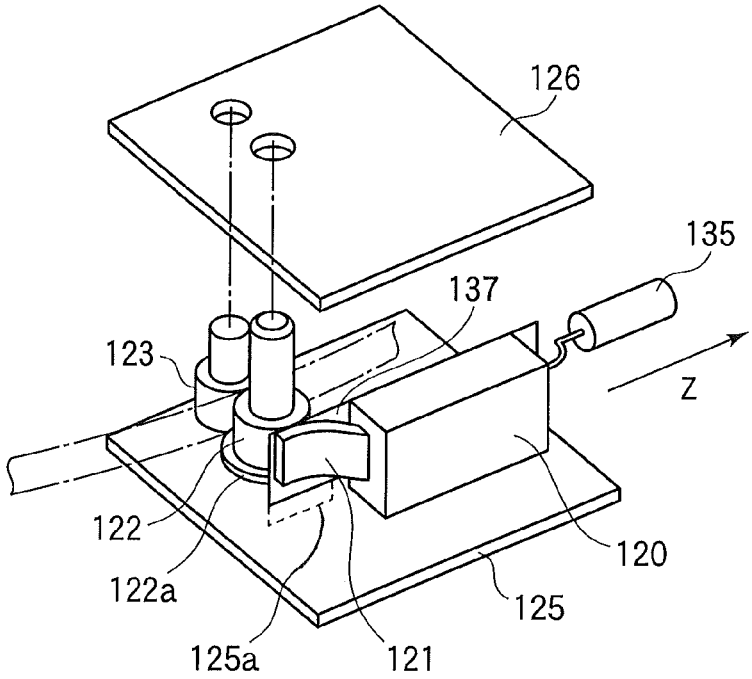
FIG. 14 illustrates the operation of the ink ribbon cartridge of the third embodiment.
Figure 15:
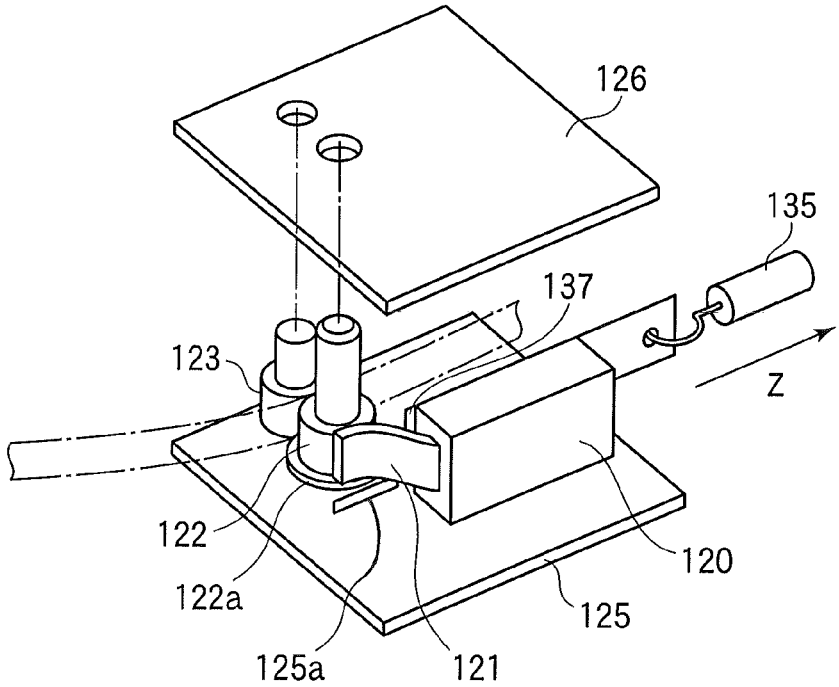
FIG. 15 illustrates the operation of the ink ribbon cartridge of the third embodiment.
Figure 16:
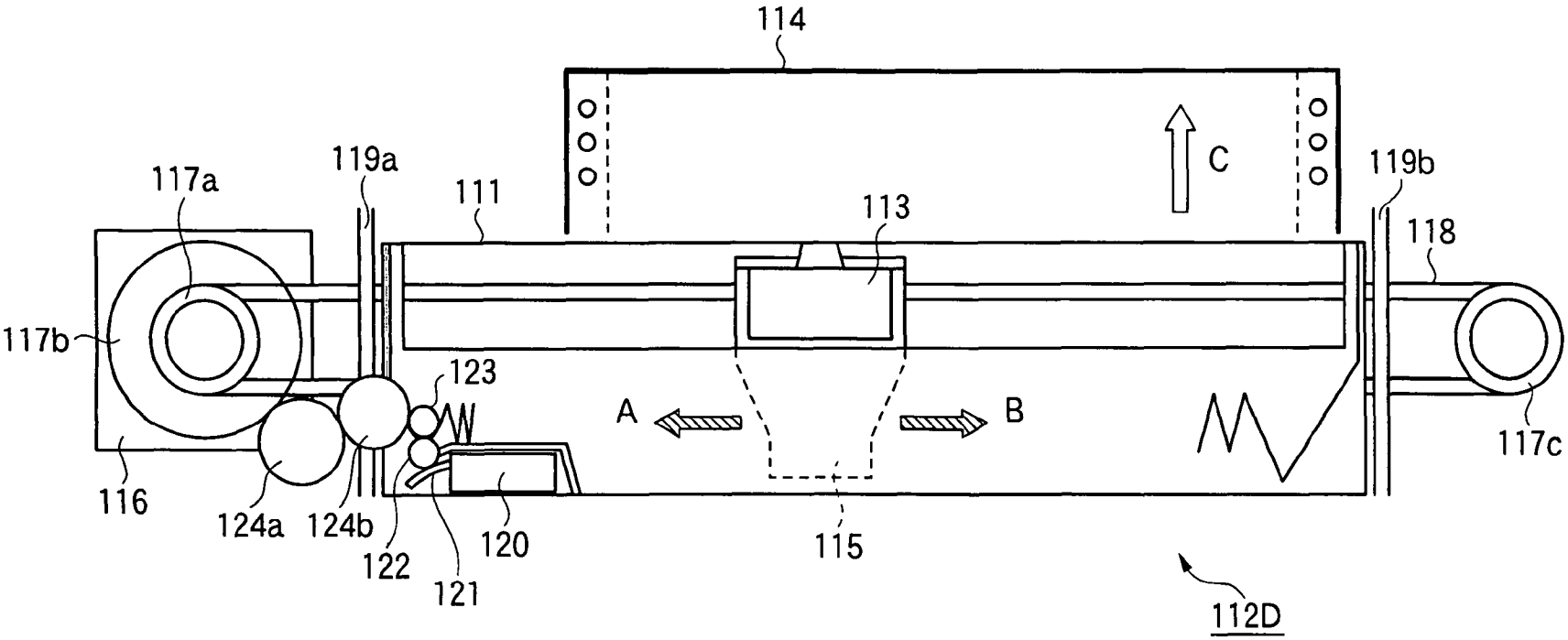
FIG.16 PRIOR ART
FIG. 16 illustrates a conventional printer.

Referring to FIGS. 14 and 15, a tension spring 135 urges the shutter 137 at all times in a direction shown by arrows Z. An end portion 137*a* of the shutter 137 projects into the slit 125*a* so that the shutter 137 is held in position relative to the housing 125.

A longitudinal end portion of the shutter 137 extends through a gap between the ink replenishing strip 121 and a transfer roller 122, so that supply of the ink from the ink tank 120 is interrupted. The transfer roller 122 includes a flange 122*a* which is in contact with a wear portion 137*a* of the shutter 137 shown in FIG. 13.

{Operation}

FIG. 14 illustrates the operation of an ink ribbon cartridge 112C of the third embodiment. FIG. 15 illustrates the operation of an ink ribbon cartridge 112C of the third embodiment.

The operation of the ink ribbon cartridge 112C and printer of the aforementioned configuration will be described with reference to FIGS. 14 and 15.

When the printer receives a print command, the controller 130 controls a spacing motor 116 to cause a carriage unit 115 and a printhead 113 to move across the paper for performing printing.

The spacing motor 116 also drives a pulley 117*b* and gears 124*a* and 124*b*, thereby driving a drive shaft (not shown) to rotate so that a drive roller 123 in the ink ribbon cartridge 112C rotates.

As a result, the transfer roller 122 and drive roller 123 cooperate with each other to cause the ink ribbon 111 sandwiched between them to advance. Because the shutter 137 prevents the ink from being delivered from the ink replenishing strip 121 to the transfer roller 122, printing is performed only using the ink in the ink ribbon 111 shortly after a new, unused ink ribbon cartridge has been attached to the printer.

When the carriage unit 115 moves in the spacing direction, the transfer roller 122 rotates. Because the flange 122*a* of the transfer roller 122 is in contact with the shutter 137, the flange 122*a* starts to cause the wear portion 137*a* of the shutter 137 to wear.

The thickness of the shutter 137 is selected such that $t1 \cong t3$ where t1 is an average amount of time required for the ink in the ink ribbon 111 to be used up during printing and t3 is an amount of time required for the wear portion 137*a* to completely wear out and cut off.

Referring to FIGS. 14 and 15, the tension spring 135 holds the shutter 137 is in tension. The shutter 137 moves in the Z direction when the wear portion 137*a* is cut off. As a result, the ink replenishing strip 121 moves into pressure contact with the transfer roller 122, so that the ink in the ink storage medium 127 starts to be supplied to the transfer roller 122 through the ink replenishing strip 121. The ink is transferred from the transfer roller 122 onto the ink ribbon 111. The ink ribbon passes through a gap between the transfer roller 122 and the drive roller 123.

{Advantages}

As described above, a portion of the shutter 137 is sandwiched between the ink replenishing strip 121 and the transfer roller 122, and is urged in a predetermined direction by the spring 135. When the portion of the shutter 137 sandwiched between the transfer roller 122 and the ink replenishing strip 121 has completely worn out, the shutter 137 is pulled out of the gap between them. This configuration eliminates the need for providing the combination of the upper ink tank 120*a* and the lower ink tank 120*b*, and providing an electromechanical driving mechanism for counting the number of printed dots and for moving the upper and lower ink tanks. The third embodiment provides a simple solution in which the ink may be replenished whenever the ink in the ink ribbon has been exhausted.

The invention has been described with respect to a configuration in which an ink replenishing strip is in pressure contact with a transfer roller in the vicinity of a portion through which the ink ribbon is advanced from the ink ribbon cartridge so that the ink is replenished to the ink ribbon. However, the ink may also be replenished in the vicinity of a portion through which the ink ribbon enters the ink ribbon cartridge.

The invention may be applied not only to serial dot printers but also to type writers and printer that employ an ink ribbon cartridge equipped with an ink replenishing mechanism.

What is claimed is:

1. An ink ribbon cartridge comprising:

an ink ribbon;

an ink impregnable member;

an ink replenishing member that extends from said ink impregnable member and replenishes ink into said ink ribbon;

an ink storing member that is impregnated with a supply of ink, said ink storing member being movable either to a first position where said ink storing member contacts said ink impregnable member and supplies the ink to said ink replenishing member via said ink impregnable member or a second position where said ink storing member does not contact said ink impregnable member and does not supply the ink to said ink replenishing member;

wherein said ink impregnable member is not impregnated with ink before the ink ribbon is unsealed, and said ink storing member moves to the first position when said ink storing member is driven by an external force.

2. The ink ribbon cartridge according to claim 1, wherein the external force is exerted by a part of an apparatus when the ink ribbon cartridge is attached to the apparatus.

3. The ink ribbon cartridge according to claim 1, wherein said ink storing member, said ink replenishing member, and said ink impregnable member are configured such that a first amount of time is substantially equal to a second amount of time, wherein the first amount of time is an amount of time required for the ink in the ink ribbon to be exhausted and the second amount of time is an amount of time required for the ink held in the ink storing member to reach the ink ribbon.

4. A printer comprising an ink ribbon cartridge according to claim 1.

5. A printer comprising an ink ribbon cartridge according to claim 2.

6. A printer comprising an ink ribbon cartridge according to claim 3.

7. A printer including an ink ribbon cartridge according to claim 1, the printer comprising:

a drive mechanism that causes said ink storing member to move into contact engagement with said ink impregnable member;

a controller that meters an amount of ink consumed during printing, metering being started for a first printing operation shortly after a new, unused ink ribbon cartridge is attached to an apparatus;

wherein said drive mechanism exerts the external force on said ink storing member when said controller detects that the amount of ink consumed reaches a predetermined value.

8. The printer according to claim 7, wherein the predetermined value is smaller than the amount of ink held in said ink ribbon before the ink ribbon cartridge is unsealed.

* * * * *